US011035091B1

(12) United States Patent
Qi et al.

(10) Patent No.: US 11,035,091 B1
(45) Date of Patent: Jun. 15, 2021

(54) TRANSPORTATION DEVICE FOR OFFSHORE PLATFORMS AND METHOD FOR INSTALLING THE SAME

(71) Applicant: PowerChina Huadong Engineering Corporation Limited, Zhejiang (CN)

(72) Inventors: Haifeng Qi, Zhejiang (CN); Chunlin Huang, Zhejiang (CN); Huafeng Yu, Zhejiang (CN); Baofeng Zhang, Zhejiang (CN); Guoer Lv, Zhejiang (CN); Zhenzhou Sun, Zhejiang (CN); Xianlin Jia, Zhejiang (CN); Gen Xiong, Zhejiang (CN); Gangjie Yu, Zhejiang (CN); Shanshan Huang, Zhejiang (CN); Guangming Xu, Zhejiang (CN); Ning Liang, Zhejiang (CN); Tianhao Li, Zhejiang (CN); Jiefeng Chen, Zhejiang (CN)

(73) Assignee: PowerChina Huadong Engineering Corporation Limited, Hangzhou (CN)

( * ) Notice: Subject to any disclaimer, the term of this patent is extended or adjusted under 35 U.S.C. 154(b) by 0 days.

(21) Appl. No.: 16/992,346

(22) Filed: Aug. 13, 2020

(30) Foreign Application Priority Data

Mar. 4, 2020 (CN) ..... 202010145105.1

(51) Int. Cl.
*E02B 17/00* (2006.01)
*B63B 35/00* (2020.01)
(Continued)

(52) U.S. Cl.
CPC ..... *E02B 17/0809* (2013.01); *B63B 35/003* (2013.01); *E02B 17/021* (2013.01); *E02B 2017/0043* (2013.01)

(58) Field of Classification Search
CPC ..... E02B 2017/0043; E02B 2017/0047; B63B 35/003
(Continued)

(56) References Cited

U.S. PATENT DOCUMENTS 1,708,784 A * 4/1929 Carloni ..... B63B 43/14 114/68
3,198,157 A * 8/1965 Livas ..... B63B 43/14 114/123
(Continued)

FOREIGN PATENT DOCUMENTS

CN 102587342 A 7/2012
CN 203806103 U 9/2014
(Continued)

*Primary Examiner* — Sunil Singh

(57) ABSTRACT

A transportation device for an offshore platform, including a vessel and a floating structure which are fixedly connected. The floating structure is placed on a sea surface and is configured to assist the vessel to sail. The floating structure is provided with an adjustment mechanism which is configured to adjust the floating structure to rise and fall relative to the sea surface. A rail is arranged on the vessel and is in sliding connection with the topside module, so that the topside module slides onto the vessel from land. During the transportation of the topside module, the buoyancy of the floating structure is adjusted through the adjustment mechanism, so that the floating structure provides sufficient anti-rolling moments beside the vessel, thereby reducing the vibration of the topside module caused by the winds and waves during the sailing and reducing the potential damage to the topside module.

10 Claims, 7 Drawing Sheets

(51) Int. Cl.
*E02B 17/08* (2006.01)
*E02B 17/02* (2006.01)

(58) Field of Classification Search
USPC ..... 405/200, 203–206, 209; 414/137.9, 414/138.1, 138.2, 138.5, 138.7, 138.8, 414/139.6, 139.8, 139.9, 140.1, 140.6; 114/259
See application file for complete search history.

(56) References Cited

U.S. PATENT DOCUMENTS 3,790,009 A * 2/1974 Hauber ..... B63B 35/28 414/803
3,844,241 A * 10/1974 Black ..... B63B 43/14 114/123
4,495,880 A * 1/1985 Maniscalco ..... B63B 35/42 114/123
4,622,912 A * 11/1986 Bleke ..... B63B 23/42 114/123
4,655,641 A * 4/1987 Weyler ..... E02B 17/027 405/204
4,662,788 A * 5/1987 Kypke ..... E02B 17/024 405/204
4,729,695 A * 3/1988 Silvestri ..... E02B 17/00 405/204
4,848,967 A * 7/1989 Weyler ..... E02B 17/024 405/204
4,930,938 A * 6/1990 Rawstron ..... E02B 17/024 405/203
5,219,451 A * 6/1993 Datta ..... E02B 17/024 405/203
6,027,287 A * 2/2000 Faldini ..... B63B 21/04 405/209
6,293,734 B1 * 9/2001 Thomas ..... E02B 17/024 114/264
10,377,450 B2 * 8/2019 Nakamura ..... B63B 21/20
2004/0218983 A1 * 11/2004 Roraas ..... E02B 17/08 405/204
2007/0253797 A1 * 11/2007 Thomas ..... B63B 27/24 414/137.1
2009/0148241 A1 * 6/2009 Ouwehand ..... E02B 17/00 405/195.1
2015/0322639 A1 * 11/2015 Ardavanis ..... B63B 35/003 405/209

FOREIGN PATENT DOCUMENTS

CN 107600351 A 1/2018
EP 0654564 * 5/1995
JP 60-195215 * 10/1985
JP 60-195216 * 10/1985
JP 60-195217 * 10/1985
WO 2010138622 A3 6/2011

* cited by examiner

TRANSPORTATION DEVICE FOR OFFSHORE PLATFORMS AND METHOD FOR INSTALLING THE SAME

CROSS-REFERENCE TO RELATED APPLICATIONS

This application claims the benefit of priority from Chinese Patent Application No. 202010145105.1, filed on Mar. 4, 2020. The content of the aforementioned applications, including any intervening amendments thereto, is incorporated herein by reference.

TECHNICAL FIELD

This application relates to installation equipment for offshore platforms, and more particularly to a transportation device for an offshore platform and a method for installing the same.

BACKGROUND OF THE DISCLOSURE

Offshore platforms include topside modules and offshore installation frames. Generally, the offshore installation frames are constructed in predetermined area, and the topside modules are transferred to the offshore installation frames through vessels, and then the topside module is installed onto the offshore installation frame. Generally, the float-over installation method is adopted to install large-scale offshore platforms. However, the offshore platform has a large span and low structural stiffness, and is easily affected by vibrations. The offshore platform that is installed by traditional float-over installation method is prone to large structural deformation, and devices of the offshore platform may be damaged due to large vibrations.

SUMMARY OF THE DISCLOSURE

An object of the present disclosure is to provide a transportation device for an offshore platform, which aims to overcome the problem that offshore platforms which have low structural stiffness are easily damaged during the transportation and installation.

To solve above technical problems, the present disclosure adopts the following technical solution.

In a first aspect, the present disclosure provides a transportation device for an offshore platform, comprising a vessel and a floating structure which are fixedly connected; wherein the floating structure is placed on a sea surface and is configured to assist the vessel to sail; the floating structure is provided with an adjustment mechanism which is configured to adjust the floating structure to rise and fall relative to the sea surface; and the vessel is configured to load a topside module.

In some embodiments, the floating structure comprises a floating body which is connected to the vessel; and the adjustment mechanism is arranged at the floating body.

In some embodiments, the floating body is provided with reinforcing bars.

In some embodiments, the floating body is a closed case.

In some embodiments, the adjustment mechanism has an injection end configured to inject water into the floating body and a drain end configured to drain water out of the floating body.

In some embodiments, the floating structure further comprises a fixing part which is configured to fix the floating body to the vessel.

In some embodiments, the fixing part comprises a plurality of connecting rods which are connected to each other to form a truss structure; and the truss structure is connected between the floating body and the vessel.

In some embodiments, the fixing part comprises one connecting rod which is connected between the floating body and the vessel.

In some embodiments, the transportation device comprises an auxiliary support; wherein one end of the auxiliary support is connected to the topside module, and the other end of the auxiliary support is connected to the vessel.

In some embodiments, the auxiliary support comprises a first support rod which is arranged in an inclined manner; one end of the first support rod is connected to the topside module, and the other end of the first support rod is connected to the vessel.

In some embodiments, the auxiliary support further comprises a second support rod which is connected between the first support rod and the topside module.

In some embodiments, a rail is provided on the vessel, and the topside module is provided with skid shoes that slide on the rail; and the skid shoes drive the topside module to slide from land to the vessel along the rail.

In some embodiments, the transportation device further comprises a support frame configured to support the topside module; wherein the skid shoes are mounted on the support frame.

In a second aspect, the present disclosure provides a method for installing an offshore platform, comprising:

1) pre-installing a first installation element on a topside module, and pre-installing a second installation element on an offshore installation frame, wherein the offshore installation frame is provided with an area allowing for entry of a vessel;

2) reducing buoyancy of a floating structure through an adjustment mechanism to lower the vessel carrying the floating structure until a deck of the vessel is flush with land; and transferring the topside module to the deck of the vessel;

3) when the vessel sails offshore, increasing the buoyancy of the floating structure through the adjustment mechanism; and transferring the topside module near the offshore installation frame through the vessel and the floating structure;

4) detaching the floating structure from the vessel;

5) driving the vessel carrying the topside module to enter the area allowing for entry of the vessel; and aligning the first installation element and the second installation element; and 6) sinking the vessel to mate the first installation element with the second installation element.

In some embodiments, the first installation element comprises a leg mating unit (LMU) and a transition structure; the transition structure is connected between the LMU and the topside module; and the LMU is configured to connect with the second installation element; or the first installation element comprises a transition structure, and the second installation element comprises an LMU; one end of the transition structure is connected to a lower end of the topside module, and the LMU is mounted at an upper end of the offshore installation frame and is configured to connect with the other end of transition structure.

The transportation device of the present invention has the following beneficial effects. The floating structure is connected to the vessel. When transporting the topside module 40 to the vessel, the buoyancy of the floating structure is reduced by the adjustment mechanism, and the vessel carrying the floating structure falls until the rail on the vessel is flush with the land, so as to transfer the topside module to the vessel. After the topside module is loaded, the vessel sails offshore, and the buoyancy of the floating structure is increased through the adjustment mechanism, and then the floating structure increases the buoyancy of the vessel, so that the floating structure provides sufficient anti-rolling moments beside the vessel, thereby ensuring the vessel to stably sail and reducing the vibration of the topside module caused by the winds and waves during the sailing. As a result, during the transportation, the structure of the topside module is effectively protected, and the potential damage to the topside module is reduced.

The method of the present invention has the following beneficial effects. During the installation, the topside module is stably transferred to the offshore installation frame through the vessel and the floating structure, which effectively prevents the topside module from damage during the transportation. The removal of the floating structure from the vessel reduces the space occupied by the vessel, which enables the vessel to move in the limited area after the vessel drives the topside module to enter the area allowing for the entry of the vessel of the offshore installation frame. Then, the vessel carries the first installation element of the topside module to align with the second installation element of the offshore installation frame. This makes the mating accurate, achieving a good installation effect.

BRIEF DESCRIPTION OF THE DRAWINGS

The present disclosure will be described with reference to the embodiments and the accompanying drawings, from which the technical solutions of the disclosure will be clearer. Obviously, the accompanying drawings are only a part of embodiments. Other drawings can be obtained without creative effort by those skilled in the art based on the embodiments described herein.

Figure 1:
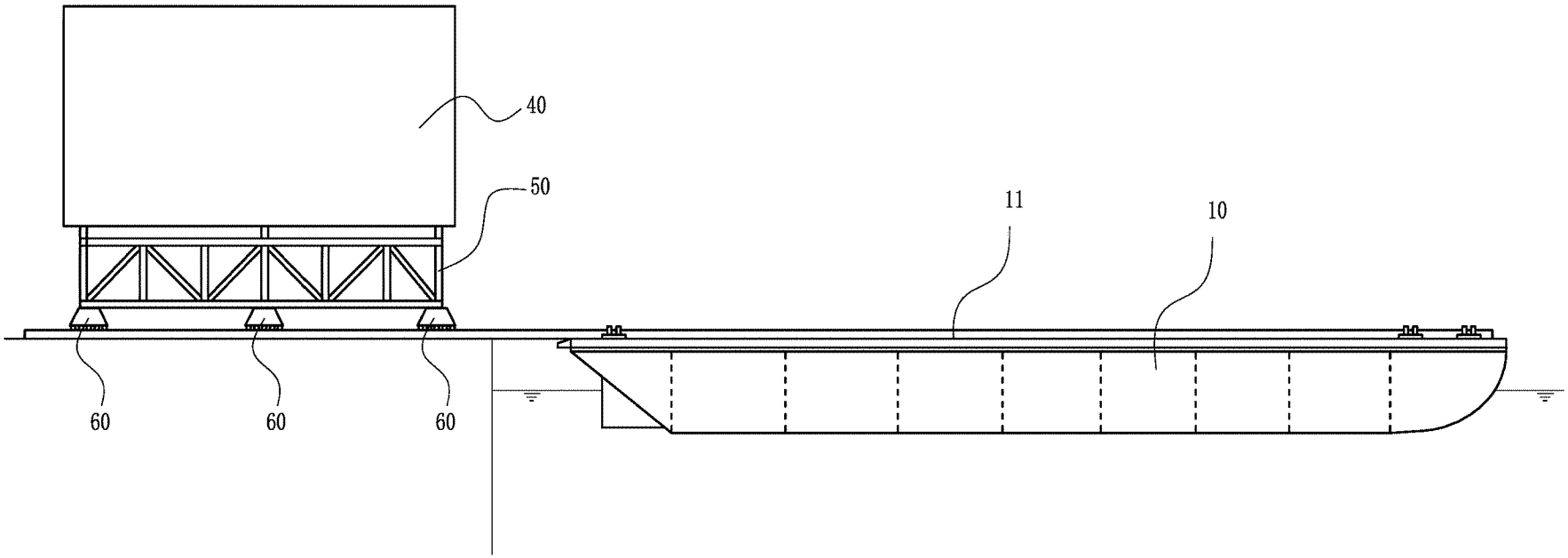
FIG. 1 is a schematic diagram of a transportation device for an offshore platform according to an embodiment of the present disclosure, on which a topside module is not loaded.

In the drawings: 10, vessel; 11, rail; 20, floating structure; 21, adjustment mechanism; 211, injection end; 212, drain end; 22, floating body; 23, fixing part; 231, connecting rod; 30, auxiliary support; 31, first support rod; 32, second support rod; 40, topside module; 41, first installation element; 411, LMU; 412, transition structure; 42, support column; 50, support frame; 60, skid shoes; 70, offshore installation frame; 71, second installation element; 72, area for entry of the vessel.

DETAILED DESCRIPTION OF EMBODIMENTS

The present disclosure will be further described as follows with reference to the accompanying drawings and embodiments, from which the objects, technical solutions and advantages of the present disclosure become clear. It should be understood the embodiments described herein are only intended to illustrate the present disclosure, but not to limit the scope of the present disclosure.

It should be noted that the terms "fix" or "arrange" should be understood broadly. For example, an element may be directly or indirectly fixed or arranged on another element. In addition, the term "connect" should be understood broadly. For example, two elements may be directly or indirectly connected. The terms "upper", "lower", "left", "right", etc. indicate the orientation or positional relationship based on the orientation or positional relationship shown in the drawings, which is only for ease of description, but not intended to indicate or imply that devices or elements must have a specific orientation or be constructed and operated in a specific orientation. Therefore, this is not intended to limit the scope of the present disclosure, and for those skilled in the art, the specific meanings of above-mentioned terms should be understood based on the specific conditions. The terms "first" and "second" are for ease of description, and cannot be understood as indicating or implying relative importance or the number of technical features. Unless specified, the term "a plurality of" means at least two.

The technical solutions of the present disclosure will be described in detail with reference to the accompanying drawings and embodiments.

Figure 2:
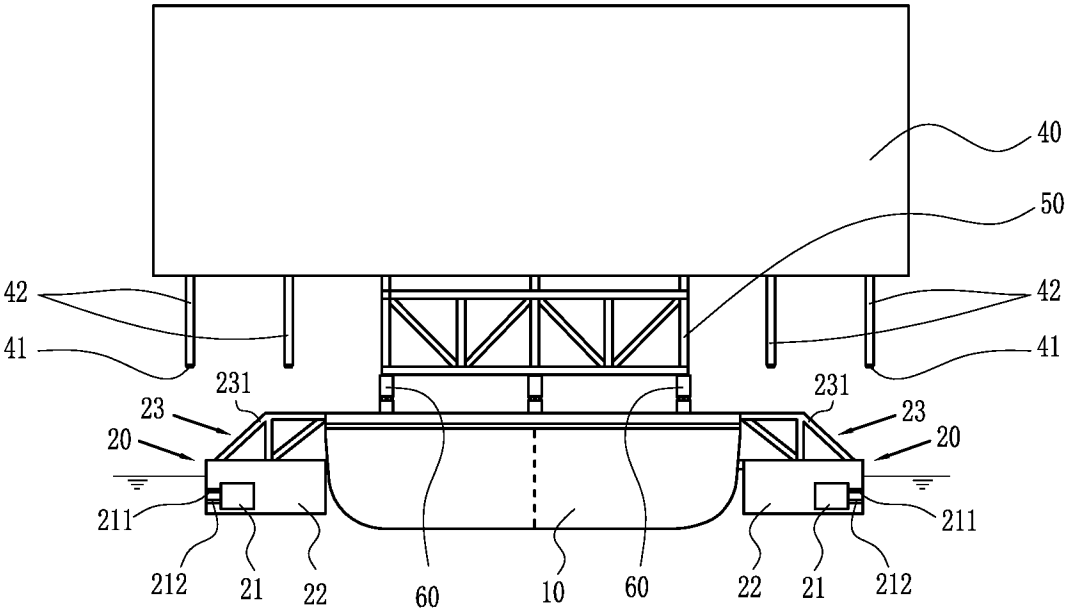
FIG. 2 is a schematic diagram of the transportation device for an offshore platform according to an embodiment of the present disclosure, on which the topside module is loaded.
Figure 3:
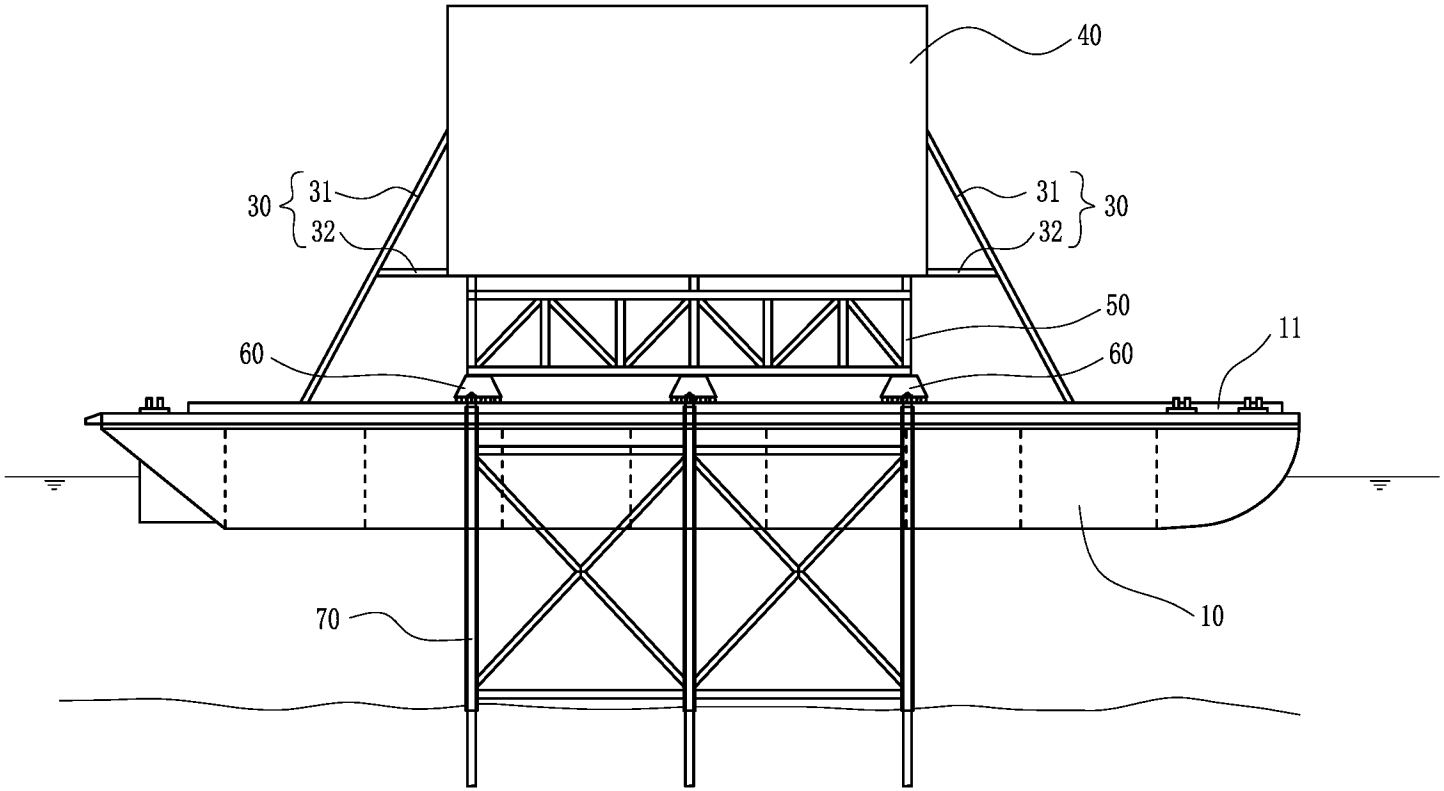
FIG. 3 is a schematic diagram of the transportation device for an offshore platform according to an embodiment of the present disclosure, in which the topside module is being transported to an area for entry of the vessel.

Referring to FIGS. 1-3, this embodiment provides a transportation device for an offshore platform, including a vessel 10 and a floating structure 20 which are fixedly connected. The floating structure 20 is placed on a sea surface and is configured to assist the vessel 10 to sail. The floating structure 20 is provided with an adjustment mechanism 21 which is configured to adjust the floating structure 20 to rise and fall relative to the sea surface. The vessel 10 is configured to load a topside module 40.

In this embodiment, the vessel 10 is connected to the floating structure 20. Before the topside module 40 is loaded onto the vessel 10, the buoyancy of the floating structure 20 is reduced through the adjustment mechanism 21, so that the floating structure 20 drives the vessel 10 to sink to a certain depth, so as to allow the vessel 10 to be flush with the land, facilitating the transmission of the topside module 40 onto the deck of the vessel 10. After the topside module 40 is loaded, the vessel 10 sails offshore, and the buoyancy of the floating structure 20 is increased through the adjustment mechanism 21, and then the floating structure 20 increases the buoyancy of the vessel 10, so that the floating structure 20 provides sufficient anti-rolling moments beside the vessel 10, thereby ensuring the vessel 10 to stably sail and reducing the vibration of the topside module 40 caused by the winds and waves during the sailing. As a result, during the transportation, the structure of the topside module 40 is effectively protected, and the probability of damage to the topside module 40 is reduced. When the installation site is arrived, the floating structure 20 can be detached from the vessel 10.

A plurality of floating bodies 20 can be arranged at the periphery of the vessel 10, which can effectively ensure that the floating bodies 20 provide sufficient anti-rolling moment during the sailing of the vessel 10, thereby facilitating the stable sailing of the vessel 10. The floating bodies 20 may be symmetrically arranged at the periphery of the vessel 10, or may be arranged based on winds and waves or sea conditions, so as to ensure the stable sailing of the vessel 10.

Universal wheels or other wheels may be arranged on the topside module 40, so that the topside module 40 is easy to be smoothly moved to the vessel 10.

In some embodiment, as shown in FIG. 2, the floating structure 20 includes a floating body 22 connected to the vessel 10. The adjustment mechanism 21 is arranged at the floating body 22. Specifically, the floating body 22 is able to synchronously sail with the vessel 10, and the adjustment mechanism 21 is configured to change the weight of the floating body 22 so as to change the buoyancy of the floating body 22, so that the floating body 22 assists the vessel 10 to sail. The floating body 22 may be loaded with various objects, such as rocks, iron topside modules or sea water, so that the weight of the object on the floating body 22 is reduced or increased to change the buoyancy of the floating body 22 on the sea. When the installation site is arrived and the floating structure 20 needs to separate from the vessel 10, the floating structure 20 and the vessel 10 can be disconnected.

In some embodiments, the floating body 22 is provided with reinforcing bars. Specifically, the reinforcing bars can effectively improve the structural strength of the floating body 22, i.e., the probability of damage to the floating body 22 caused by striking of waves is effectively reduced, so that the floating body 22 can effectively assist the vessel 10 to sail.

In some embodiments, as shown in FIG. 2, the floating body 22 is a closed case. Specifically, when the floating body 22 is a closed case, it is easy to enable the floating body 22 to sail with the vessel 10. During the sailing, the adjustment mechanism changes the amount of seawater loaded in the floating body 22, which is easy to use, and has a simple structure and low cost.

In some embodiments, as shown in FIG. 2, the adjustment mechanism 21 has an injection end 211 which is configured to inject water into the floating body 22 and a drain end 212 which is configured to drain the water out of the floating body 22. Specifically, when the floating body 22 is a closed case, the amount of water in the floating body 22 can be adjusted in time by using the injection end 211 and the drain end 212, which is safe and convenient. The injection end 211 can pump seawater into the floating body 22 through an injection pump, and the drain end 212 can pump the seawater out of the floating body 22 through a drain pump. The injection end 211 and the drain end 212 are automatically or manually controlled.

In some embodiments, as shown in FIG. 2, the floating structure 20 further includes a fixing part 23 which respectively connects with the floating body 22 and the vessel 10. Specifically, the floating body 22 is fixed to the vessel 10 through the fixing part 23, which facilitates the mounting of the floating body 22. In addition, through the fixing part 23, it is convenient to adjust the angle between the floating body 22 and the vessel 10. Specifically, the floating body 22 may be perpendicular to the side of the vessel 10, or an acute angle may be formed between the floating body 22 and the side of the vessel 10. Due to different angles between the floating body 22 and the vessel 10, the floating body 22 applies forces of different directions to the vessel 10 through the fixing part 23. Thus, the direction of the force that the floating body 22 exerts on the vessel 10 can be adjusted by adjusting the mounting angle between the floating body 22 and the vessel 10, so that the floating body 22 can better assist the vessel 10 to sail. When the floating body 22 needs to separate from the vessel 10 after the installation site is arrived, the fixing part 23 can be removed from the vessel 10.

In some embodiments, as shown in FIG. 2, the fixing part 23 includes a plurality of connecting rods 231 which are connected to each other to form a truss structure. The truss structure is connected between the floating body 22 and the vessel 10. Specifically, the connecting rods are connected to each other to form a truss structure with multiple triangles. Such truss structure has high structural strength and large impact resistance. When the truss structure is connected between the floating body 22 and the vessel 10, the floating body 22 is capable of withstanding complex sea conditions and impact of waves on the sea, which prevents the floating body 22 from separating from the vessel 10 during the transportation, thereby ensuring the safety of the sailing.

In some embodiments, as shown in FIG. 2, the fixing part 23 includes a connecting rod 231 which is connected between the floating body 22 and the vessel 10. Specifically, the fixing part 23 is one connecting rod 231, which has a simple structure and low cost. Besides, when using one connecting rod, it is convenient to connect the floating body 22 and the vessel 10, and the angle between the floating body 22 and the vessel 10 is easy to be adjusted, so that the direction of the force that the floating body 22 exerts on the vessel 10 is easy to be adjusted.

In some embodiments, as shown in FIG. 3, the transportation device further includes auxiliary supports 30. One end of the auxiliary support 30 is connected to the topside module 40, and the other end of the auxiliary support 30 is connected to the vessel 10. Specifically, through the auxiliary supports 30, the topside module 40 is stably transported on the sea. After the topside module 40 is transported to a predetermined area, the auxiliary supports 30 are detached from the topside module 40, facilitating subsequent installation and positioning of the topside module 40. The auxiliary supports 30 may be symmetrically arranged at the periphery of the topside module 40, or may be arranged based on winds and waves or sea conditions, so as to ensure that the topside module is stably arranged on the vessel 10.

In some embodiments, as shown in FIG. 3, the auxiliary supports include a plurality of first support rods 31 which are arranged in an inclined manner. One end of the first support rod 31 is connected to the topside module 40, and the other end of the first support rod 31 is connected to the vessel 10. Specifically, the first support rods 31 are arranged in an inclined manner. One end of the first support rod 31 abuts against the side of the topside module 40, and the other end of the first support rod 31 abuts against the deck of the vessel 10, so that a triangular support structure is formed by the topside module 40, the deck of the vessel 10 and the first support rod 31, which can stably support the topside module 40. This effectively prevents the topside module 40 from moving relative to the vessel 10 during the transportation, thereby protecting the topside module 40. The first support rod 31 may be connected to a middle of the topside module 40, so that the topside module 40 is subject to a more even force during the supporting, leading to a good support effect.

In some embodiments, as shown in FIG. 3, the auxiliary support 30 further includes a second support rod 32 which is connected between the first support rod 31 and the topside module 40. Specifically, the second support rod 32 is connected between the first support rod 31 and the side of the topside module 40, so that a triangular support structure is formed by the first support rod 31, the side of the topside module 40 and the second support rod 32. In this way, the topside module 40 is supported more stably, preventing the topside module 40 from moving relative to the vessel 10 during the transportation. The second support rod 32 may be horizontally connected between the first support rod 31 and the topside module 40, which allows the triangle support structure formed by the first support rod 31, the side of the topside module 40 and the second support rod 32 to be more stable, realizing a better support effect.

In some embodiments, as shown in FIGS. 1 and 3, the vessel 10 is provided with a rail 11, and the topside module 40 is provided with skid shoes 60. The skid shoes 60 are configured to slide on the rail 11, so that the topside module 40 is carried to slide from the land to the vessel 10 along the rail 11. Specifically, when transporting the topside module 40 to the vessel 10, the buoyancy of the floating structure 20 is reduced by the adjustment mechanism 21, and the floating structure 20 drives the vessel 10 to fall until the rail 11 on the vessel 10 is flush with the land. This allows the skid shoes 60 on the topside module 40 to be easily placed on the rail 11 and smoothly move on the rail 11, so that the topside module 40 is transferred to the vessel 10. In this way, the topside module 40 is smoothly transferred to the vessel 10, preventing the topside module 40 from suffering structural damages when it is transferred to the vessel 10. After the topside module 40 is transferred to the vessel 10, the skid shoes 60 are locked on the rail 11, so as to prevent the skid shoes from sliding on the rail 11 during the transportation of the topside module 40, i.e., to avoid the sliding of the topside module 40 during the transportation.

Figure 4:
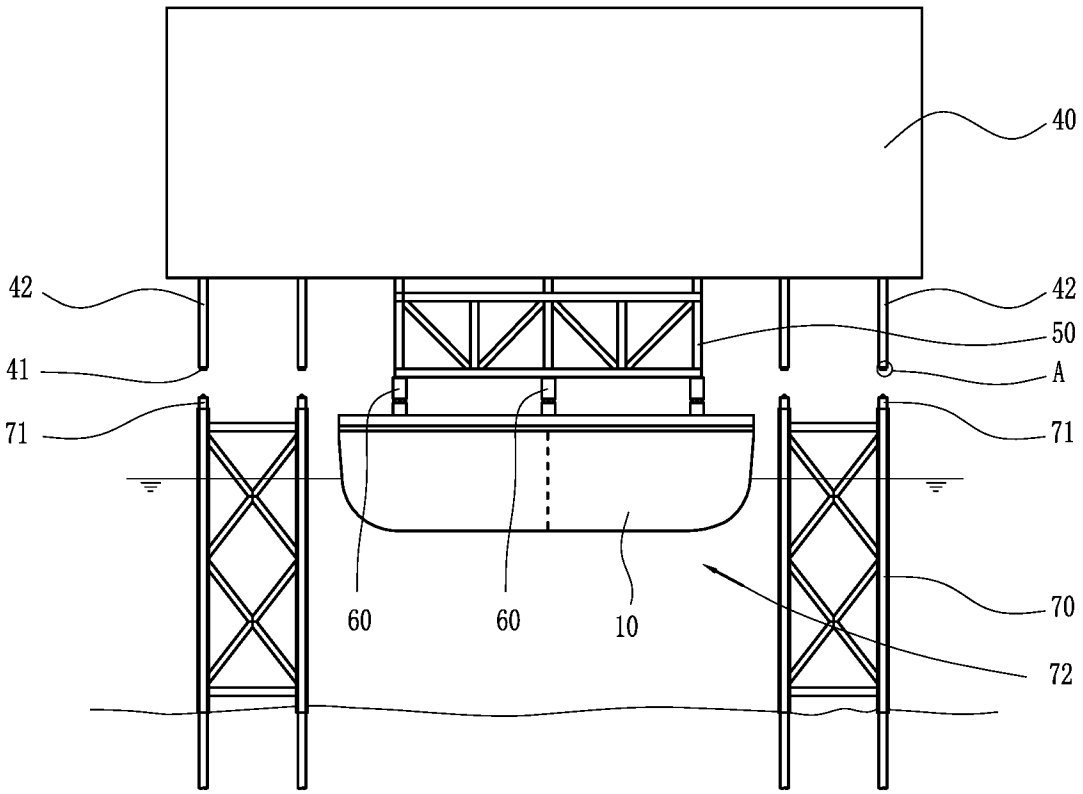
FIG. 4 schematically shows the installation of the topside module on the offshore installation station according to an embodiment of the present disclosure.

In some embodiments, as shown in FIGS. 2-4, the transportation device further includes a support frame 50 which is configured to support the topside module 40. The skid shoes are mounted on the support frame 50. Specifically, the support frame 50 is located at the middle of the lower part of the topside module 40, so as to ensure that the center of gravity of the topside module 40 is stable during the transportation, which allows the topside module 40 to suffer a uniform force during the transportation. In this way, the topside module 40 with a larger span is prevented from structural deformations during the transportation, thus effectively protecting the topside module 40.

As shown in FIGS. 2, 4, 5 and 7, this embodiment provides a method for installing the offshore platform, comprising the following steps.

S1) A first installation element 41 is pre-installed at the topside module 40, and a second installation element 71 is pre-installed at an offshore installation frame 70, where the offshore installation frame 70 is provided with an area 72 for the entry of the vessel 10.

S2) The adjustment mechanism 21 reduces the buoyancy of the floating structure 20, so that the floating structure 20 drives the vessel 10 to fall until the deck of the vessel is flush with the land, and then the topside module 40 is transferred onto the deck of the vessel 10.

S3) when the vessel 10 sails offshore, the buoyancy of the floating structure 20 is increased through the adjustment mechanism 21, and the topside module 40 is transferred to the offshore installation frame 70 by the vessel 10 and the floating structure 20.

S4) The floating structure 20 is removed from the vessel 10.

S5) The vessel 10 drives the topside module 40 to enter the area 72 allowing for entry of a vessel, and the first installation element 41 aligns with the second installation element 71.

S6) The vessel 10 is sunk to mate the first installation element 41 with the second installation element 71.

During the installation, the topside module 40 is stably transferred to the offshore installation frame 70 through the vessel 10 and the floating structure 20, which effectively prevents the topside module 40 from damage during the transportation. The removal of the floating structure 20 from the vessel 10 reduces the space occupied by the vessel 10, which enables the vessel 10 to move in the limited area 72 after the vessel 10 drives the topside module 40 to enter area 72 of the offshore installation frame 70. Then, the vessel carries the first installation element 41 of the topside module 40 to align with the second installation element 71 of the offshore installation frame 70. This makes the mating accurate, achieving a good installation effect.

Multiple groups of the first installation element 41 and the second installation element 71 may be provided to improve the connection between the topside module 40 and the offshore installation frame 70.

Figure 5:
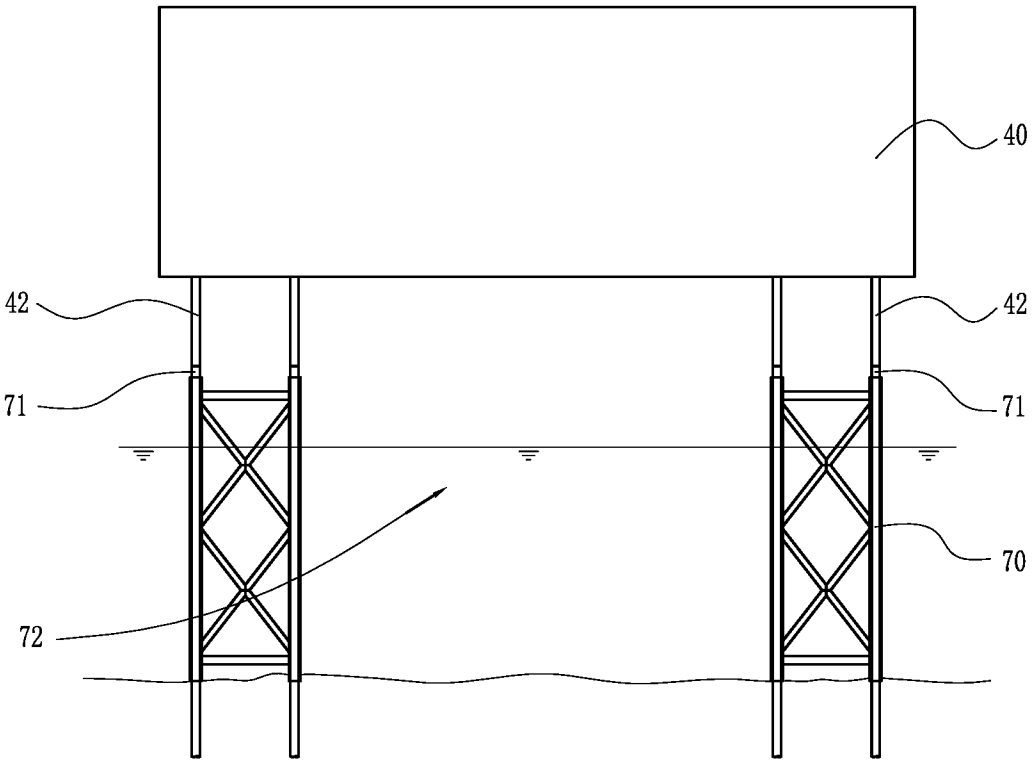
FIG. 5 a schematic diagram of the topside module which is installed to the offshore installation frame according to an embodiment of the present disclosure, in which the topside module is installed.
Figure 6:
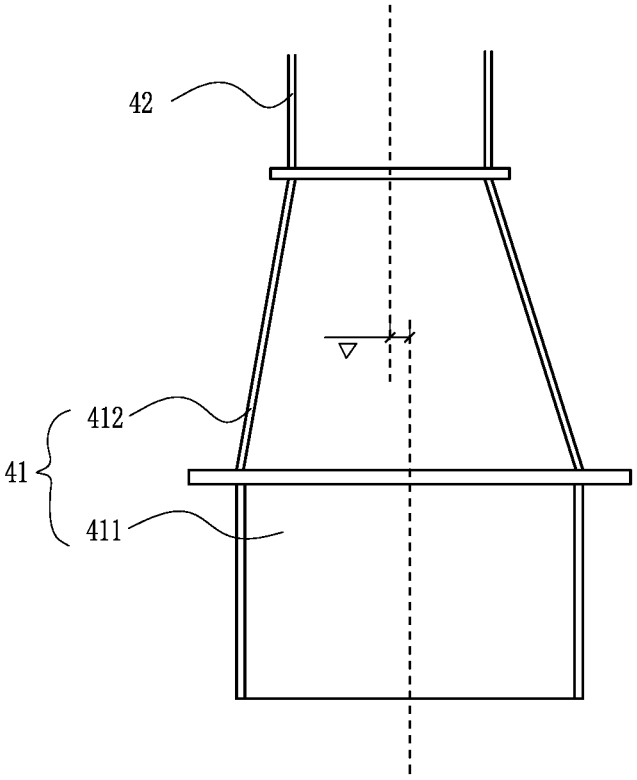
FIG. 6 is an enlarged view of portion A in FIG. 4.
Figure 7:
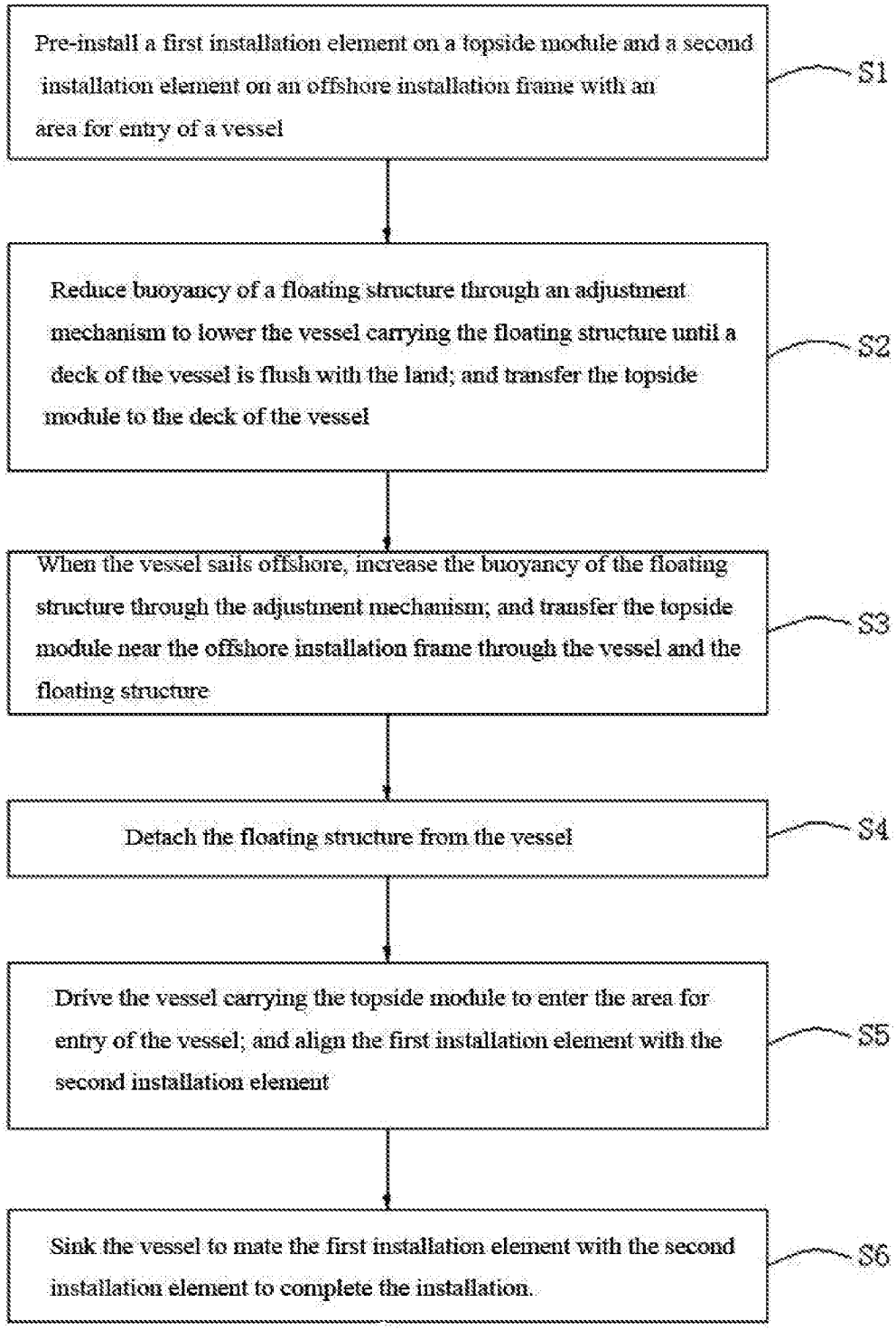
FIG. 7 is a flowchart of a method for installing the offshore platform according to an embodiment of the present disclosure.

In some embodiments, as shown in FIGS. 4-6, the first installation element 41 includes a leg mating unit (LMU) 411 and a transition structure 412. The transition structure 412 is connected between the LMU 411 and the topside module 40, and the LMU 411 is configured to connect the second installation element 71 which is a support such as a steel tube. Specifically, after the offshore installation frame 70 is installed in the target sea area in advance, actual distances of the second installation elements 71 on the offshore installation frame 70 are measured, and the first installation elements 41 are installed on the topside module 40 on the land according to the measured data. This eliminates the adverse impact of the construction errors of the second installation elements 71 on the mating of the first installation elements 41 and the second installation elements 71. Thus, when constructing the second installation elements 71 on the offshore installation frame 70, the construction error of the second installation elements 71 can be appropriately increased, so that the construction process of the offshore installation frame 70 can be greatly simplified and the construction difficulty of the offshore installation frame 70 is reduced. The first installation element 41 mates with the second installation element 71 by the LMU 411 at the end of the first installation element 41. A transition structure 412 is provided between the topside module 40 and LMU 411, and center lines of two ends of the transition structure 412 are offset, so that the construction error of the LMU 411 can be offset by the transition structure 412, which effectively improves the range for mating the LMU 411 and the second installation element 412. In this way, the requirement for position accuracy of the LMU 411 can be lowered, so as to reduce the difficulty of the construction.

The transition structure 412 may be a tapered object which is hollow, and center lines of openings at two ends of the tapered object are offset. The transition structure 412 may be a tubular object, and center lines of openings at two ends of the tubular object are offset.

A support column 42 is arranged between the topside module 40 and the transition structure 412 to support the topside module 40. The LMU is located at the lowermost end of the support column 42, and is configured to mate with the second installation element 71 on the offshore installation frame 70.

In some embodiments, the first installation element 41 includes the transition structure, and the second installation element 71 includes the LMU. One end of the transition structure is connected to a lower end of the topside module 40, and the LMU is arranged on the upper end of the offshore installation frame 70 and is connected to the other end of the transition structure. Specifically, when the LMU is arranged on the offshore installation frame 70, the topside module 40 mates with the LMU through the transition structure of the first installation element 41 which is a support such as a steel pipe. The mounting process is as follows. The LMUs are mounted on the upper end of the offshore installation frame 70, and position data of the LMUs on the offshore installation frame 70 is measured. Based on the measured position data, the transition structures are added onto the topside module 40 on the land, and positions of the transition structures are adjusted on the topside module 40. As a result, requirements for the precision of positions of the LMU and the transition structure are reduced, thereby reducing the difficulty of construction.

When installing the topside module 40 on the offshore installation frame 70, a buffer sandbox may be arranged on the offshore installation frame 70, so as to reduce strong collisions between the vessel 10 and the offshore installation frame 70.

The above are only a part of embodiments of the present disclosure, and are not intended to limit the scope of the present disclosure. Various modifications and changes of these embodiments can be made by those skilled in the art. Any modification, equivalent replacement, improvement, etc. made within the spirit and principle of the present disclosure shall fall within the scope of the appended claims.

What is claimed is:

1. A transportation device for an offshore platform, comprising a vessel and a floating structure which are fixedly connected;

wherein the floating structure is placed on a sea surface and is configured to assist the vessel to sail; the floating structure is provided with an adjustment mechanism which is configured to adjust the floating structure to rise and fall relative to the sea surface; and the vessel is configured to load a topside module of the offshore platform;

the transportation device further comprises an auxiliary support; wherein one end of the auxiliary support is connected to the topside module, and the other end of the auxiliary support is connected to the vessel;

the auxiliary support comprises a first support rod which is arranged in an inclined manner; one end of the first support rod is connected to the topside module, and the other end of the first support rod is connected to the vessel; and the auxiliary support further comprises a second support rod, and one end of the second support rod is connected to the topside module, and the other end of the second support is connected to the first support rod.

2. The transportation device of claim 1, wherein the floating structure comprises a floating body which is connected to the vessel; and the adjustment mechanism is arranged at the floating body.

3. The transportation device of claim 2, wherein the floating body is provided with reinforcing bars.

4. The transportation device of claim 2, wherein the floating body is a closed case.

5. The transportation device of claim 2, wherein the adjustment mechanism has an injection end configured to inject water into the floating body and a drain end configured to drain water out of the floating body.

6. The transportation device of claim 2, wherein the floating structure further comprises a fixing part which is configured to fix the floating body to the vessel.

7. The transportation device of claim 6, wherein the fixing part comprises a plurality of connecting rods which are connected to each other to form a truss structure; and the truss structure is connected between the floating body and the vessel.

8. The transportation device of claim 6, wherein the fixing part comprises one connecting rod which is connected between the floating body and the vessel.

9. The transportation device of claim 1, wherein a rail is provided on the vessel, and the topside module is provided with skid shoes that slide on the rail; and the skid shoes drive the topside module to slide from land to the vessel along the rail.

10. The transportation device of claim 9, further comprising a support frame configured to support the topside module; wherein the skid shoes are mounted on the support frame.

* * * * *